United States Patent [19]

Lawson, Jr.

[11] Patent Number: 4,676,030

[45] Date of Patent: Jun. 30, 1987

[54] APPARATUS AND METHOD FOR DETECTING A TOOL EDGE

[75] Inventor: Harold W. Lawson, Jr., Shelton, Conn.

[73] Assignee: Moore Special Tool Co., Inc., Bridgeport, Conn.

[21] Appl. No.: 903,219

[22] Filed: Sep. 2, 1986

[51] Int. Cl.[4] ..... B24B 49/00

[52] U.S. Cl. ..... 51/165.75; 51/165.77; 51/165.87; 51/165.88; 51/281 R; 324/61 R

[58] Field of Search ..... 324/61 R, 207, 208; 51/165 R, 165.87, 165.88, 165.75, 281 R, 165.77

[56] References Cited

U.S. PATENT DOCUMENTS

| | | | |
|---|---|---|---|
| 2,957,126 | 10/1960 | Wright | 324/207 |
| 2,971,263 | 2/1961 | Rockafellow | 51/165.75 |
| 4,401,946 | 8/1983 | Klimstra | 324/208 |
| 4,571,892 | 2/1986 | Brill | 51/165.88 |

*Primary Examiner*—Harold D. Whitehead
*Attorney, Agent, or Firm*—Kramer and Brufsky

[57] ABSTRACT

A force transducer and circuit are used to detect the edge of a rotating grinding wheel. The force transducer produces an output signal indicative of a force applied thereto. The output signal is filtered by a high pass filter coupled to the output of the transducer. The amplitude of the filtered transducer output signal is compared to a reference value. An output pulse is produced if the amplitude reaches a predetermined level with respect to the reference value. A timer responsive to a first output pulse establishes a fixed interval during which the number of subsequent output pulses is counted. If the number of pulses counted during the fixed interval reaches a predetermined quantity, a control signal indicative of edge contact of the grinding tool with the force transducer is produced.

10 Claims, 3 Drawing Figures

APPARATUS AND METHOD FOR DETECTING A TOOL EDGE

BACKGROUND OF THE INVENTION

The present invention relates to an apparatus and method for detecting the edge of a tool undergoing rapid periodic movement, and more particularly, to detecting the outermost cutting edge of a rotating grinding wheel.

Conventional grinding of surfaces in a workpiece can be accomplished by use of a grinding tool mounted on a jig grinder. The tool, of cylindrical configuration, is mounted on a rotatable spindle. The machine also has a spindle which moves relative to an X and Y-axis as well as vertically along a Z-axis, and can rotate about its own centerline which is known as the C-axis. The tool is independently movable relative to the C-axis along what is commonly termed the U-axis. The tool can also rotate about its own centerline. The movement of the tool along any combination of these axes (or other axes, as will be apparent to those skilled in the art) can be automatically controlled by a computerized program to grind the workpiece in a contoured predetermined pattern which will result in a contoured shape. Alternately, the grinding process can be performed manually. This invention relates to an apparatus and method for detecting the outermost cutting edge of a grinding tool or the like, so that proper dimensioning or sizing of a workpiece can be achieved.

In the past, contact of a tool edge with a workpiece or a fixed reference point was accomplished using visual, optical (e.g., laser), sound detection, or other mechanical or electromechanical detection techniques. In precision grinding or other precision machine tool applications, a tool edge may be moved in increments of several millionths of an inch. It is sometimes difficult to accurately detect the contact of a tool with a workpiece when working to such tolerances. Accordingly, it would be advantageous to provide an accurate method for detecting the edge of a tool undergoing rapid periodic movement (such as a rotating, and vertically reciprocating grinding wheel). It would be further advantageous to provide such an apparatus and method wherein an electrical control signal is produced in response to such tool edge detection.

The present invention relates to such an apparatus and method.

SUMMARY OF THE INVENTION

In accordance with the present invention, an apparatus and method are provided for detecting the edge of a tool undergoing rapid periodic movement. An example of such a tool is a rotating abrasive wheel used for grinding.

Force transducer means are provided having a force pickup member. The force transducer means produces an output signal indicative of a force applied to the pickup member. High pass filter means are coupled to the output of the transducer. Comparator means are provided for comparing the amplitude of the filtered transducer output signal from the filter means to a reference value. The comparator means produces an output pulse if the amplitude reaches a predetermined level with respect to the reference value. Timer means are provided to time a fixed interval starting from the point at which a first output pulse is received from the comparator means. The number of output pulses produced by the comparator means within the fixed interval is counted by a counter. Logic means produce a control signal if the number of pulses counted by the counter within the fixed interval reaches a predetermined quantity.

Means can further be provided for resetting the counter upon production of a control signal by the logic means. Similarly, the timer can be reset upon production of a control signal.

The high pass filter means typically will filter frequencies below 50 kHz, and pass only those frequencies above 50 kHz. Thus, any force picked up by the force transducer having a frequency below 50 kHz will be ignored by the comparator circuitry.

The present invention has application to detecting the outermost cutting position of a grinding wheel or other tool while in its dynamic condition, including a vibrating tool, reciprocating tool, rotating tool, or the like. Once the tool edge is detected in accordance with the present invention, a reference point is established so that proper dimensioning or sizing of a workpiece can be accomplished.

DETAILED DESCRIPTION OF THE INVENTION

Figure 1:
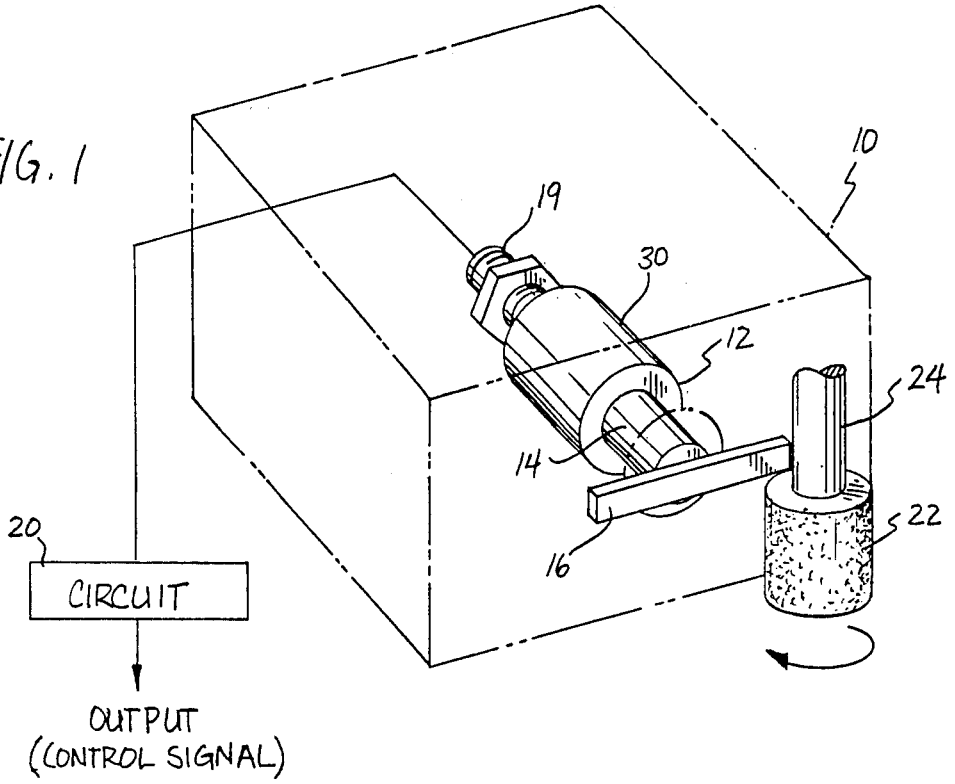
FIG. 1 is a diagrammatic view of an edge detecting apparatus in accordance with the present invention.

Turning to FIG. 1, a force transducer, generally designated 30, is mounted within a block 10 which is adapted to be mounted to the worktable of a machine tool. Force transducer 30 may be, for example, a piezoelectric transducer such as that manufactured by Dytran Instruments, Inc. of Chatsworth, Calif. and designated Model 1050MI. This transducer is a low impedance voltage mode piezoelectric sensor designed to measure dynamic forces over a broad frequency range. A voltage output is produced analogous to dynamic force inputs, which voltage is amplified by an integral amplifier to produce a low impedance level output voltage.

As shown in FIG. 1, force transducer 30 has a straight edge pickup 16 coupled thereto via a threaded rod 14 which fits into a corresponding threaded hole in impact cap 12 of transducer 30. In this manner, a force which is brought to bear against pickup 16 will cause transducer 30 to provide an electrical output signal which is applied, in turn, to a circuit 20 described in more detail below. In accordance with the present invention, the force applied to pickup 16 is from a tool undergoing rapid periodic movement, such as an abrasive wheel 22 which is rotated about shaft 24 by a jig grinder in which the tool is used.

Figure 2:
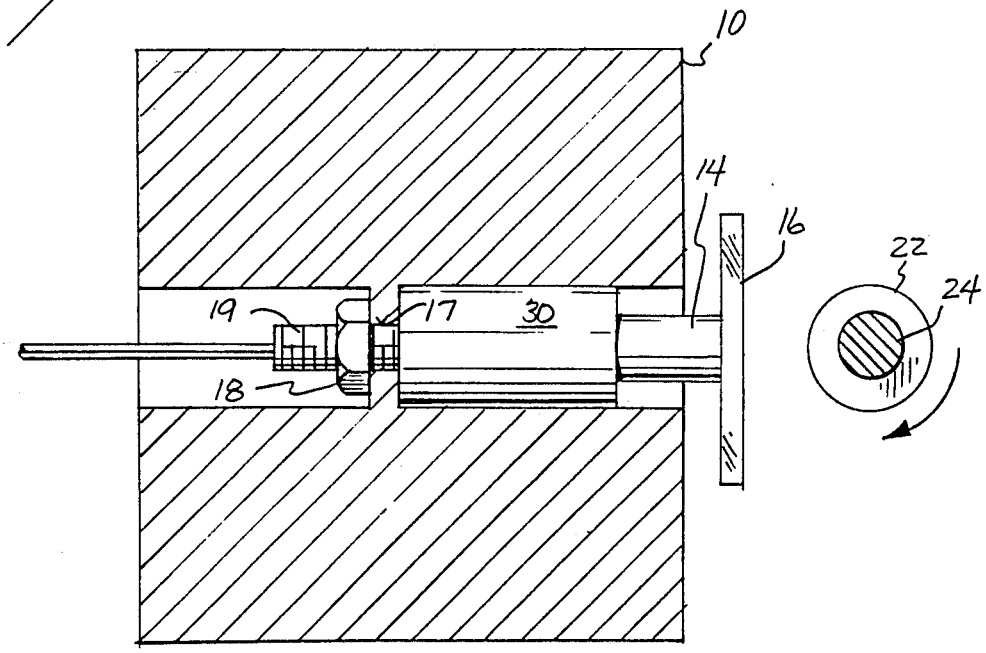
FIG. 2 is a top cross-sectional view of the force transducer in accordance with the present invention mounted within a reference block.

FIG. 2 illustrates a method for mounting the transducer 30 of FIG. 1 within a mounting block. Transducer 30 is inserted into a counter bore in mounting block 10 until it rests against a base 17 within the mounting block. An axial, integral mounting stud 19 extends from transducer 30 through a hole in base 17 and is threaded to receive nut 18. By tightening nut 18 against the back of base 17, transducer 30 is securely mounted into mounting block 10. Mounting block 10 can then be secured in a conventional fashion to the worktable of a machine tool, so that the front surface of pickup 16 provides a reference point for a tool such as grinding wheel 22.

In operation, the rotating grinding wheel 22 is incremented towards pickup 16. In a precision machining operation, such increments can be on the order of 8–10 microinches or less. When the abrasive edge of rotating wheel 22 contacts pickup 16, high frequency impulses are detected by transducer 30. The high frequency impulses are caused by the abrasive particles of the grinding wheel coming in contact with pickup 16.

Figure 3:
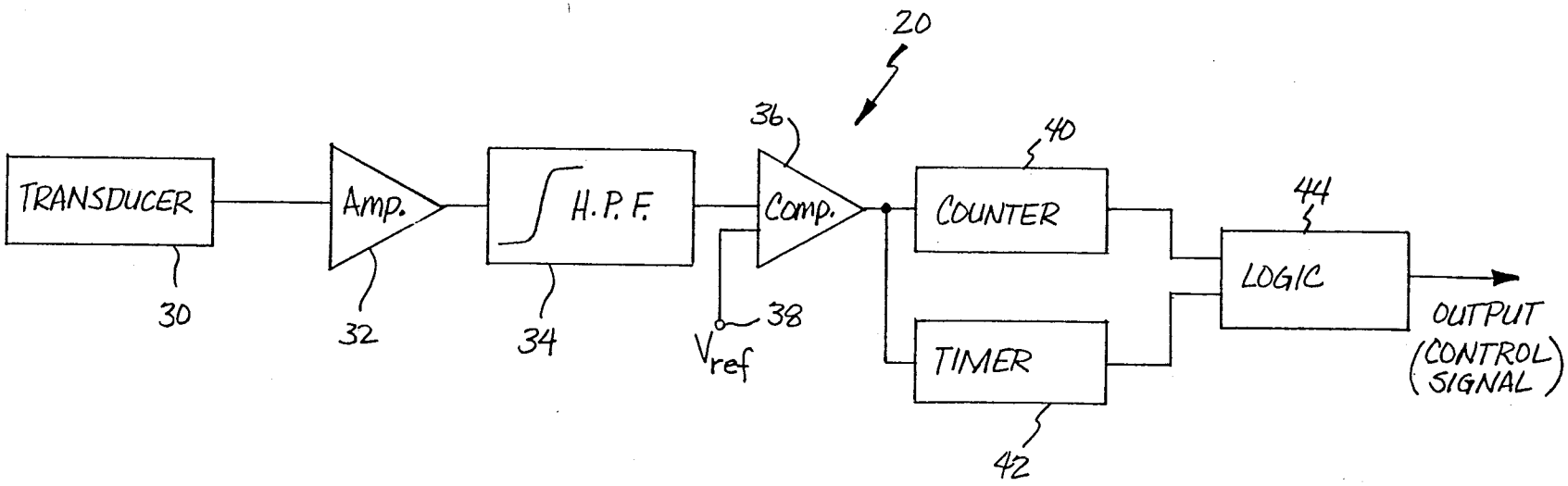
FIG. 3 is a block diagram of an electrical circuit for use in producing a control signal upon detection of the edge of a tool.

A circuit for processing the high frequency impulses and producing a control signal indicative of edge contact with the grinding wheel is shown in block diagram form in FIG. 3.

As shown in FIG. 3, transducer 30 is coupled to an amplifier 32 which provides a low impedance output voltage analogous to the dynamic forces input to the transducer. The output of amplifier 32 is filtered by a high pass filter 34 which allows frequencies of over 50 kHz to pass. The amplitude of the signal output from high pass filter 34 is compared, in a comparator 36, to a reference voltage at terminal 38 of the comparator. If the amplitude of the signal output from high pass filter 34 is at or above the preset reference voltage, a digital pulse is sent from comparator 36 to a counter 40. At the same time, the pulse from comparator 36 is input to a timer 42. The first pulse from comparator 36 will cause timer 42 to commence timing a preset time interval. During the fixed interval timed by timer 42, counter 40 will keep a count of the pulses output from comparator 36. If during the fixed time interval, a predetermined number of pulses occurs, logic 44 (which is coupled to both counter 40 and timer 42) will produce a control signal at its output. The control signal output from logic 44 can be coupled to an appropriate controller for the machine tool (e.g., jig grinder) which interprets the control signal as an indication that the tool edge has contacted the reference point established by pickup 16.

If the number of pulses counted by counter 40 during the time interval established by timer 42 is less than the predetermined number, counter 40 is reset and no control signal is output from logic 44. Similarly, once logic 44 produces a control signal, both counter 40 and timer 42 can be reset so that the procedure can be repeated.

Logic 44 can be fabricated from conventional TTL logic elements or alternately may be embodied in a custom logic integrated circuit. The functions of circuit 20 can also be implemented in a microprocessor, as will be apparent to those skilled in the art.

A contact detector constructed and operated in accordance with the present invention will not generate a control signal unless pickup 16 detects the edge of a tool undergoing rapid periodic movement. Merely presenting a force to pickup bar 16 will not normally provide the proper frequency and amplitude of pulses necessary for logic 44 to output a control signal. The provision of circuit 20 ensures that the only contacts with pickup 16 that will be effective are those having frequencies above the cutoff of high pass filter 34 (e.g., 50,000 Hz). Then, comparator 36 ensures that only those high frequency signals above a certain amplitude will be considered. Finally, if both the frequency and amplitude of the force detected by transducer 30 is proper, counter 40 and timer 42 combined with logic 44 ensure that the duration of the signal is sufficient to indicate that proper edge contact has been made by pickup 16 with the rotating, reciprocating, vibrating, or otherwise rapidly moving tool.

Although a single embodiment of the invention has been illustrated and described herein, those skilled in the art will appreciate that numerous modifications and adaptations may be made thereto without departing from the spirit and scope of the following claims.

I claim:

1. Apparatus for detecting the edge of a tool undergoing rapid periodic movement comprising:

force transducer means having a force pickup member, for producing an output signal indicative of a force applied to said pickup member;

high pass filter means coupled to the output of said transducer;

comparator means for comparing the amplitude of the filtered transducer output signal from said filter means to a reference value and producing an output pulse if said amplitude reaches a predetermined level with respect to said reference value;

timer means responsive to a first output pulse from said comparator means for timing a fixed interval;

counter means for counting the number of output pulses produced by said comparator means within the fixed interval timed by said timer means; and logic means for producing a control signal if the number of pulses counted by said counter means within said fixed interval reaches a predetermined quantity.

2. The apparatus of claim 1 further comprising means for resetting said counter means when said logic means produces a control signal.

3. The apparatus of claim 2 further comprising means for resetting said timer means when said logic means produces a control signal.

4. The apparatus of claim 1 wherein said high pass filter means passes frequencies above approximately 50 kHz.

5. The apparatus of claim 1 wherein said tool is a rotating abrasive wheel.

6. A method for detecting the edge of a tool undergoing rapid periodic movement comprising the steps of:

producing an electrical output signal indicative of a force applied to a pickup member;

filtering said output signal to eliminate frequencies below a predetermined threshold frequency;

comparing the amplitude of the filtered output signal to a reference amplitude and producing an output pulse if the output signal amplitude reaches a predetermined level with respect to said reference amplitude;

timing a fixed interval commencing with the production of a first output pulse;

counting the number of subsequent output pulses produced at said comparing step during said fixed interval; and producing a control signal if the number of pulses counted within said fixed interval reaches a predetermined quantity.

7. The method of claim 6 comprising the further step of reinitializing said counting upon the production of said control signal.

8. The method of claim 7 comprising the further step of reinitializing the timing of said fixed interval upon the production of said control signal.

9. The method of claim 6 wherein said predetermined threshold frequency is approximately 50 kHz.

10. The method of claim 6 wherein said tool is a rotating abrasive grinding wheel.

* * * * *